United States Patent [19]

Chow et al.

[11] Patent Number: 4,961,662

[45] Date of Patent: Oct. 9, 1990

[54] FOUNTAIN BRUSH ASSEMBLY

[75] Inventors: Ho Chow, Cliffside Park; Sidney J. Goodman, Paramus, both of N.J.

[73] Assignee: Hunter-Melnor, Inc., Memphis, Tenn.

[21] Appl. No.: 197,286

[22] Filed: May 23, 1988

[51] Int. Cl.[5] ..... A46B 11/02; A46B 11/06; A47L 13/17

[52] U.S. Cl. ..... 401/42; 401/43; 401/204; 401/207; 401/266; 401/289

[58] Field of Search ..... 401/40, 41, 42, 43, 401/196, 203, 204, 266, 286, 288, 289; 239/310, 315, 316, 317, 522, 498; 15/29; 134/93; 68/17 R; 128/66; 222/630

[56] References Cited

U.S. PATENT DOCUMENTS

| | | | |
|---|---|---|---|
| 630,600 | 8/1899 | Durant | 401/43 |
| 1,051,328 | 1/1913 | Harnes et al. | 401/291 |
| 1,188,262 | 6/1016 | Frederick | 401/288 |
| 1,334,911 | 3/1920 | Lampkin | 401/266 |
| 1,509,448 | 9/1924 | Skinner | 239/522 |
| 2,538,542 | 1/1951 | Tucker | 401/266 |
| 2,584,631 | 2/1952 | Soss | 401/40 X |
| 2,613,381 | 10/1952 | Tucker | 401/43 |
| 3,589,819 | 6/1971 | Bryant | 401/289 X |
| 3,775,017 | 11/1973 | Jerry | 401/266 |
| 3,797,708 | 3/1974 | Sypal | 239/310 X |
| 4,401,273 | 8/1983 | Olson | 239/498 |

FOREIGN PATENT DOCUMENTS

| | | | |
|---|---|---|---|
| 709849 | 8/1941 | Fed. Rep. of Germany | 401/289 |
| 3013495 | 10/1981 | Fed. Rep. of Germany | 401/289 |
| 522285 | 3/1955 | Italy | 239/310 |

*Primary Examiner*—Steven A. Bratlie

*Attorney, Agent, or Firm*—James and Franklin

[57] ABSTRACT

A fountain brush assembly is provided with a removable and replaceable series of brush heads through which a cleaning fluid such as water readily passes to the surface to be cleaned, the assembly including a reservoir for detergent to be selectively added to the water, control of the use and amount of the detergent being effected through manipulation of the cover for the reservoir.

5 Claims, 4 Drawing Sheets

FOUNTAIN BRUSH ASSEMBLY

This invention relates to a brush assembly adapted to be associated with a source of cleaning fluid such as water and to provide for the selective use of different types of brush heads and the selective mixture of a detergent with the cleaning fluid.

Fountain brushes adapted to be connected to water sources, such as a conventional faucet, and carrying brush elements for scrubbing or otherwise treating the surfact to be cleaned while the water from the faucet is delivered thereto, and also including means by which cleaning compounds such as detergent can be added to the water are known and have taken many forms. It is highly advantageous to provide such a device with a plurality of different and selectively usable brush heads, the term "brush" being here generically used to refer to anything that is rubbed over the surfact to be cleaned (bristles, sponge, felt, etc.). Making the brush head removable, however, has presented problems with respect to structural simplicity as well as providing for proper fluid flow through the assembly to the surface being cleaned. It has also been recognized that providing the assembly with means for holding a quantity of detergent (the term "detergent" is here used generically to mean any substance facilitating the cleaning effect of the water or other fluid employed) to be used when the assembly is functioning is a feature greatly appreciated by the purchasing public, but accommodating such a function in a simple and inexpensive brush assembly which will permit the use of ordinary liquid or powdered detergent and which will in a simple manner enable the user of the device to determine whether and to what extent the detergent will be used at any given time has presented serious problems, particularly with regard to size, simplicity and cost of the equipment.

In some instances all that is desired is to have a damp or moist brush which is rubbed over the surface to be cleaned, but far more frequently there is a need for a copious fluid flow over that surface while the cleaning is being accomplished, in part to wash away the freed dust, dirt and grease and in part to minimize the abrasive effect of the brush elements, which might otherwise mar the shine or polish of the surface being cleaned.

In accordance with the present invention, a brush head carrier is designed to be attached to a faucet, as by means of a length of hose, so that water will flow through it. That is well known. In our invention a plurality of separately usable brush heads are individually removably mounted on the carrier at a relatively wide opening at the surface of the carrier, and those brush heads are provided with an aperture or apertures of appreciable size through which water can readily pass, and the carrier is so designed as to make optimum use of that aperture. As a result the flow of water through the carrier to the surface to be cleaned is relatively unimpeded and hence a copious and free flow of such liquid results. This has the added, and significant, advantage that the interior of the carrier, and particularly the chamber portion thereof which communicates with the brush head, need not be sealed or maintained under pressure in use. This greatly facilitates and simplifies the manner in which the brush heads may be removably attached to the carrier. Preferably the fluid flow path in the carrier includes means for reducing the impact of the fluid flow onto the surface engaged by the brush, this preferably being accomplished by an inclined and stepped wall which forces the fluid flow to change its direction and which diffuses that flow.

Formed as a part of the carrier, and readily acessible, is a reservoir for detergent. That reservoir can be in fluid communication with the stream of water flowing through the carrier in order for that water, or more accurately a selected proportion of that water, to flow through the reservoir, mix with the detergent, and then pass to the surface being cleaned. The reservoir is provided with a cover which can be positioned to permit access to the reservoir for filling it with detergent. That cover performs another important function—in one position, as when it is closed down, it interrupts communication between the reservoir and the fluid flowing through the carrier, as a result of which only that fluid, and no detergent, passes to the surface being cleaned. As the cover is moved away from that "closed" position communication between the reservoir and the fluid flow through the carrier is established, and to a controllable degree depending upon the position of the cover, thereby enabling the user to control not only whether or not detergent is used but also the amount of detergent that is used. The movement of the cover to effect that control is such that the reservoir is not opened to the outside, and hence the detergent is reliably retained within the reservoir at all times.

All of this is accomplished by a simple construction which can be readily and inexpensively manufactured of a suitable molded plastic material, there are no moving parts (the cover does not move during normal operation, but remains in the position in which it is set), and the end product is not only sturdy but also attractive.

It is the prime object of the present invention to devise a fountain brush assembly in connection with which different brush heads can be readily and effectively alternately associated.

It is another prime object of the present invention to provide a fountain brush assembly providing for storage of detergent and ready and fool-proof control of the use, and the degree of use, of such detergent as the brush assembly functions.

It is another object of the present invention to devise a fountain brush assembly which is sturdy, inexpensive and attractive without detriment to its functional efficiency.

It is yet another object of the present invention to devise a fountain brush assembly which provides for copious and relatively free fluid flow to the surface being cleaned but at the same time effectively provides for an effective brushing effect over that surface.

To the other accomplishment of the above, and to the attainment of such other objectives as may hereafter appear, the present invention relates to the construction of a fountain brush assembly as defined in the appended claims and as described in this specification, taken together with the accompanying drawings, in which:

Figure 1:
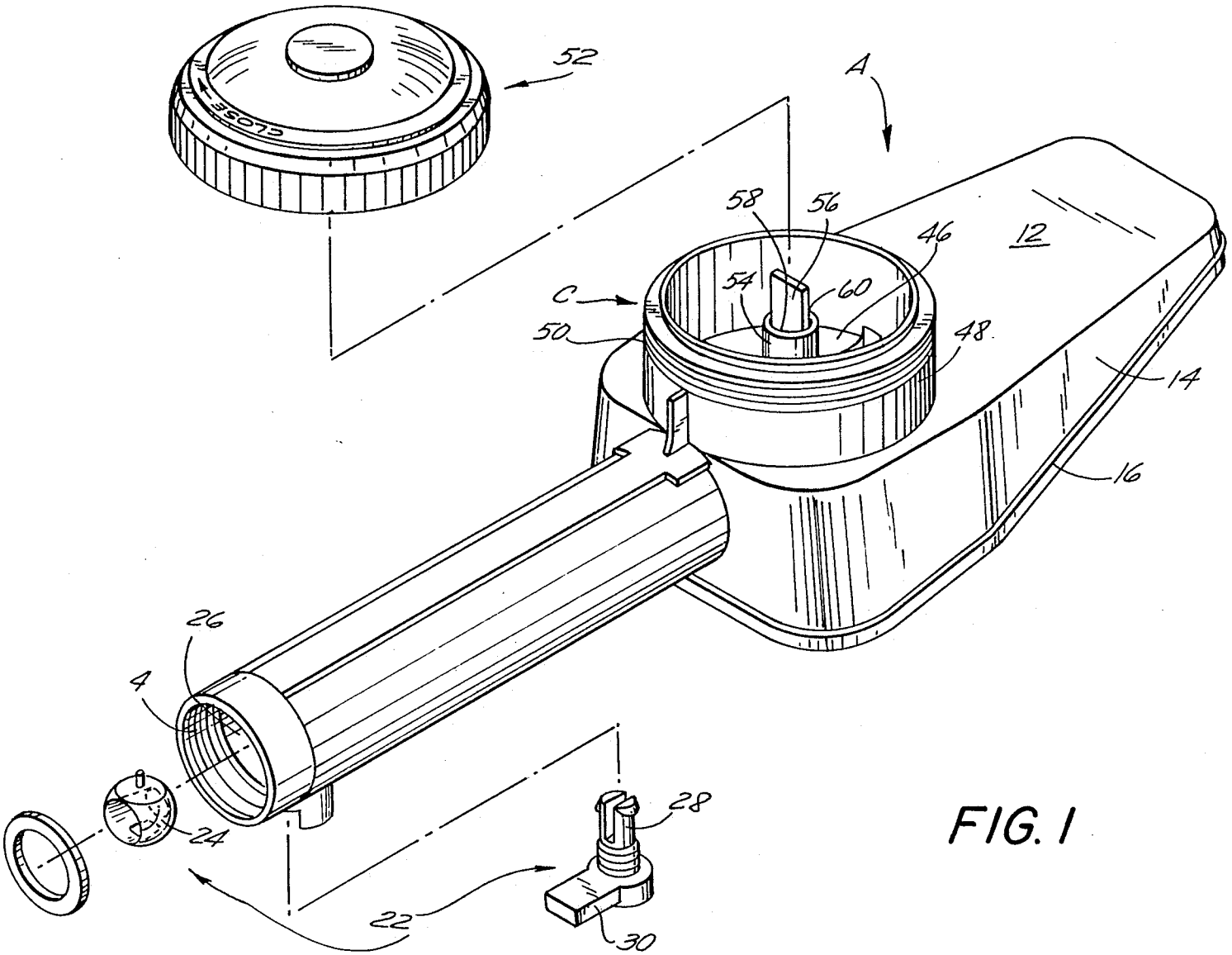
FIG. 1 is a three-quarter exploded view of the carrier portion of the assembly of the present invention, the cover for the detergent container and the parts of the optional on-off control valve being shown removed from their normal position.

The fountain brush assembly of our invention comprises a carrier generally designated A to which brush heads generally designated B are removably attachable, the individual brush heads B being differently constructed in order to produce different cleaning effects. Mounted on the carrier A is a reservoir generally designated C for holding detergent which is selectively usable, and to a readily controllable degree, as the cleaning operation is carried out.

The carrier A comprises a tubular handle portion 2 adapted at its outer end to be connected to any suitable source of cleaning fluid such as water, as by means of an internally threaded section 4 into which the end of a conventional garden hose may be screwed. That internally threaded section 4 communicates with a passage 6 which in turn communicates with a downwardly extending exit tube 8 having an open end 10, the tube 8 being received within a relatively large chamber 11 open at its bottom end defined by the top wall 12 and the side walls 14. The chamber 11 is surrounded by a bead or ridge 16 near the bottom of the side wall 14. The passage 6 and the tube 8 are essentially at right angles to one another, connected by the inclined wall 18 having a ridged exposed surface 20.

If desired, and as here specifically disclosed, the tube 2 may be provided with an on-off control generally designated 22 and comprising a rotatable and horizontally apertured ball valve 24 received in a countersunk portion 26 of the passage 6 and connected by shaft 28 to a control lever 30 exposed at the outside of the handle 2. The ball valve 24 rotates with the shaft 28 and the control lever 30 so as to move between the "on" position shown in FIGS. 1 and 4, in which the horizontal aperture through the ball valve 24 communicates between the internally threaded portion 4 and the passage 6, and an "off" position rotated 90° relative thereto in which that horizontal aperture is out of communication with the passage 6 so that fluid will not flow therethrough.

Figure 2:
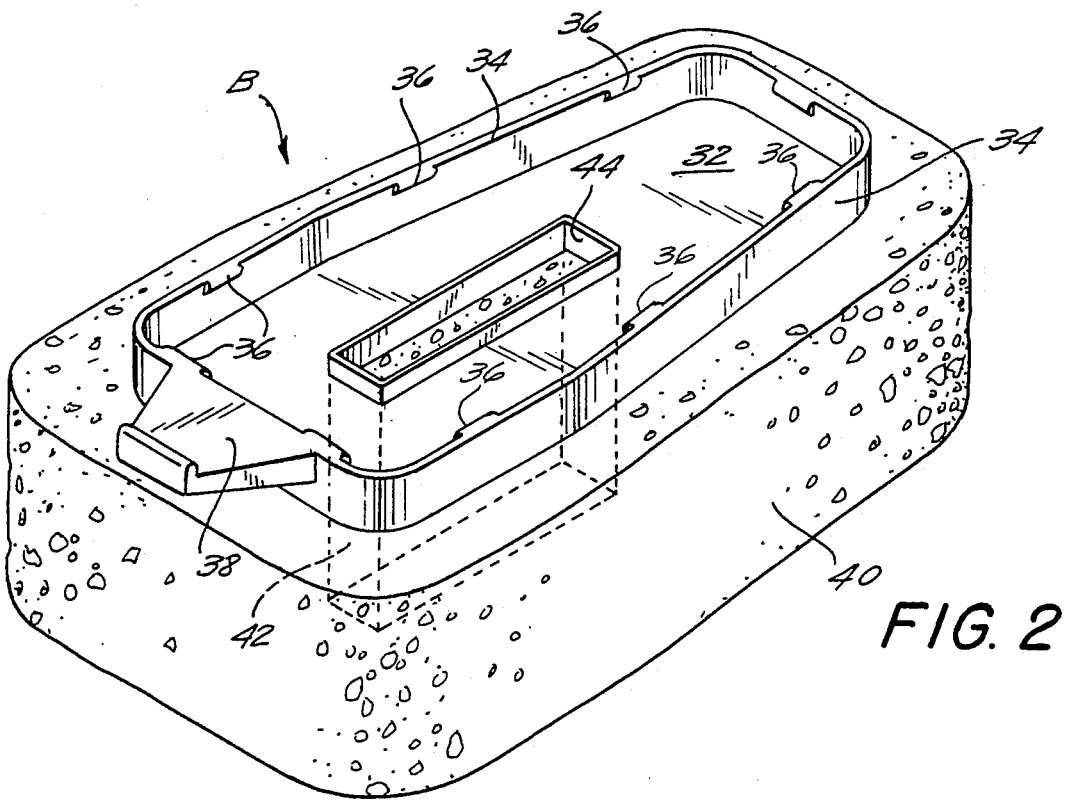
FIGS. 2 and 3 are three-quarter perspective views of two alternative brush heads, the brush head of FIG. 2 carrying a sponge brush and the brush head of FIG. 3 carrying bristle brush elements.
Figure 3:
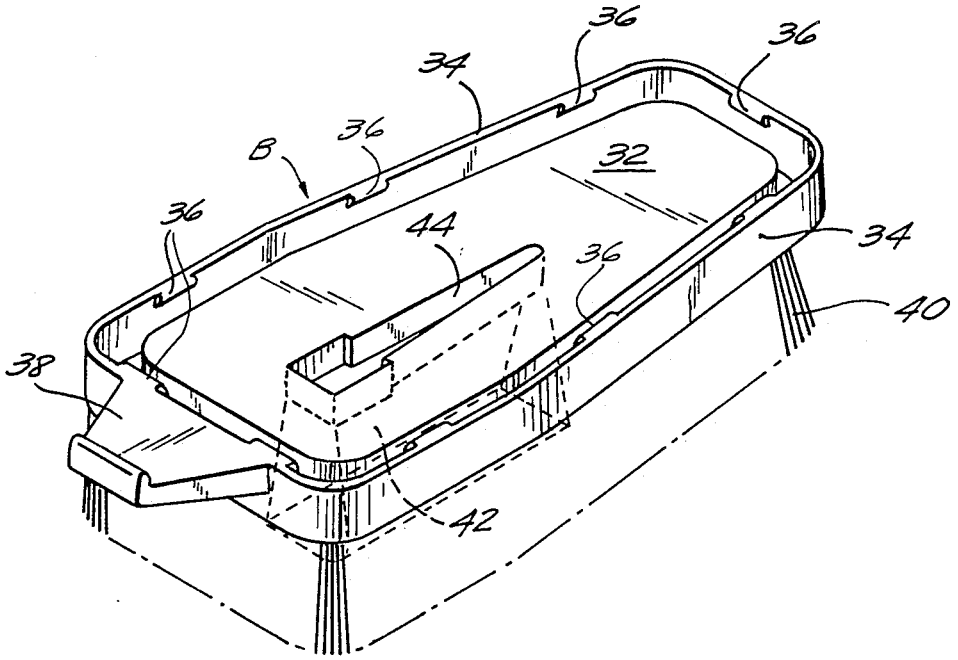

The brush heads B, of which two illustrative different embodiments are shown in FIGS. 2 and 3 respectively, comprise a support plate 32 of an areal extent somewhat greater than that of the downwardly extending opening of the chamber 11 of the carrier A, surrounded by an upstanding wall 34 shaped to fit snugly over the lower ends of the side walls 14 of the carrier A and having inward projections 36 shaped to engage and snap over the bead or ridge 16 on the outer surfaces of those carrier side walls 14, thereby to releasably mount the support plate 32 on the carrier A. A tab 38 extends outwardly from the wall 34 at an end of the support plate 32 to facilitate attachment and detachment of the support plate 32.

Secured to the lower surface of the support plate 32 in any appropriate manner is the brushing member 40 itself. In FIG. 2 the brushing member 40 is shown as a sponge the areal extent of which can be greater than that of the support plate 32, while in FIG. 3 the brushing member 40 is shown in the form of tufts of bristles of desired stiffness. It will be understood that these are but illustrative embodiments, and that other brushing members 40 could be used.

Common to both of the brushing members 40 is a gap 42 more or less centrally disposed with respect thereto, which gap registers with an at least roughly correspondingly shaped opening 44 in the support plate 32. The opening 44 and the communicating gap 42 are, when the brush head B is in place on the carrier A, in fluid communication with the open lower end 10 of the exit tube 8, which end 10 is preferably received within the opening 44, as may best be seen from FIGS. 4 and 5.

The detergent reservoir C is mounted on and extends un from the top of the carrier A. It comprises a bottom wall 46 and a side wall 48 provided with an externally threaded open top 50, onto which the cover 52 is threadedly received. Centrally positioned within the reservoir C is an open-ended tube 54 the inside of which is separated by a partition 56 into passages 58 and 60, each having at its bottom an opening 62 and 64 respectively communicating with the passage 6, the opening 62 being located upstream from and somewhat higher than the opening 64. The water pressure at opening 62 is slightly higher than at opening 64. The upper end of the partition 56 extends above the tube 54, and the upper edge 66 of the tube 54 is inclined. The cover 52 is provided with a central depending cup 68 the lower surface 70 of which is inclined to mate with the surface 66. The inside diameter of cup 68 fits very closely to the upper end of the partition 56. The cover 52 is also provided with a depending inner flange 72 so located as to engage the inner surface of the reservoir side wall 48 when the cover is screwed down, the upper portion of that inner surface being tapered, as at 74, to facilitate the screwing down of the cover 52 and the consequent sealing of the interior of the reservoir C.

Figure 4:
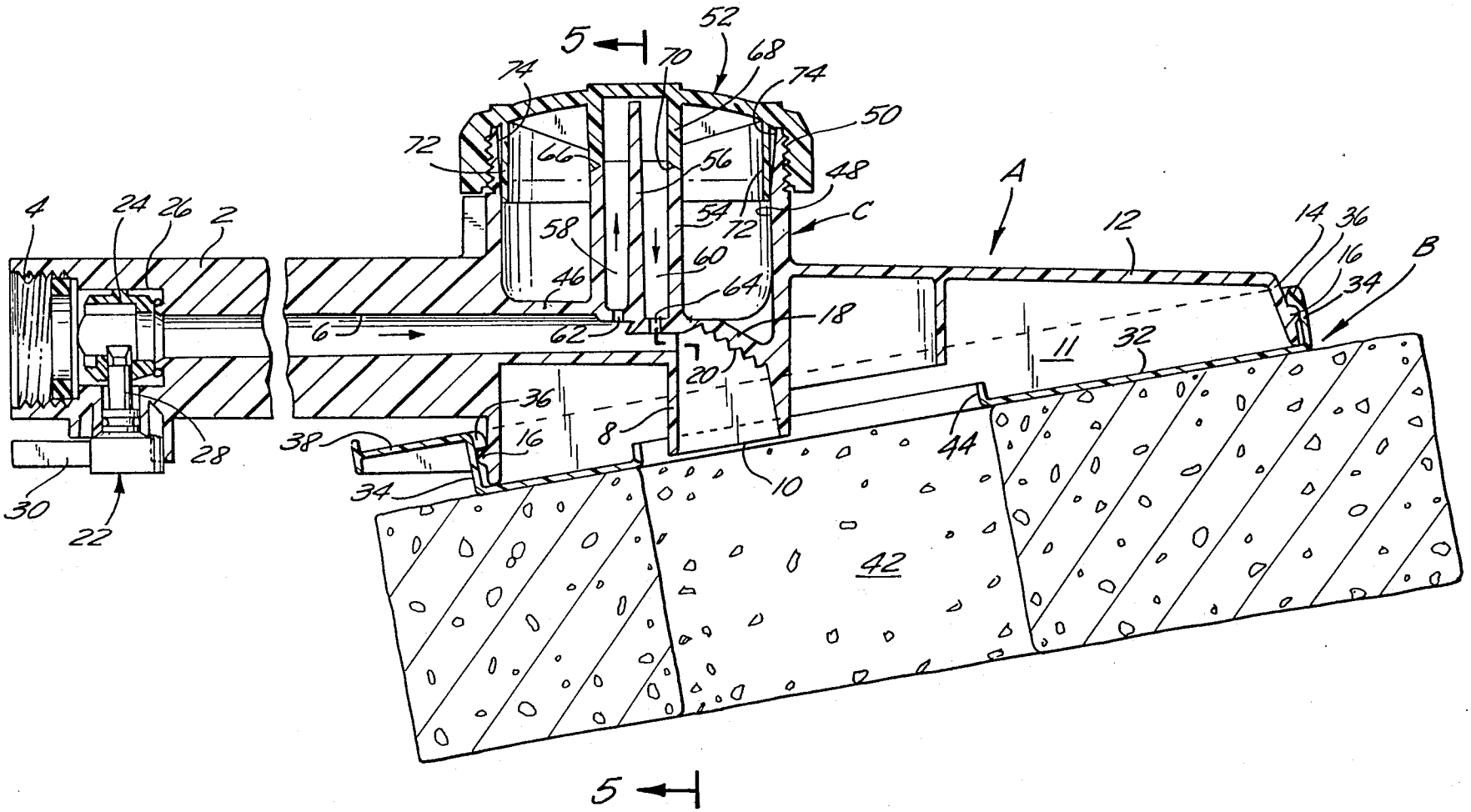
FIG. 4 is a vertical cross-sectional view of the fountain brush assembly with a sponge brush head attached thereto and showing the detergent container cover in its closed position.
Figure 5:
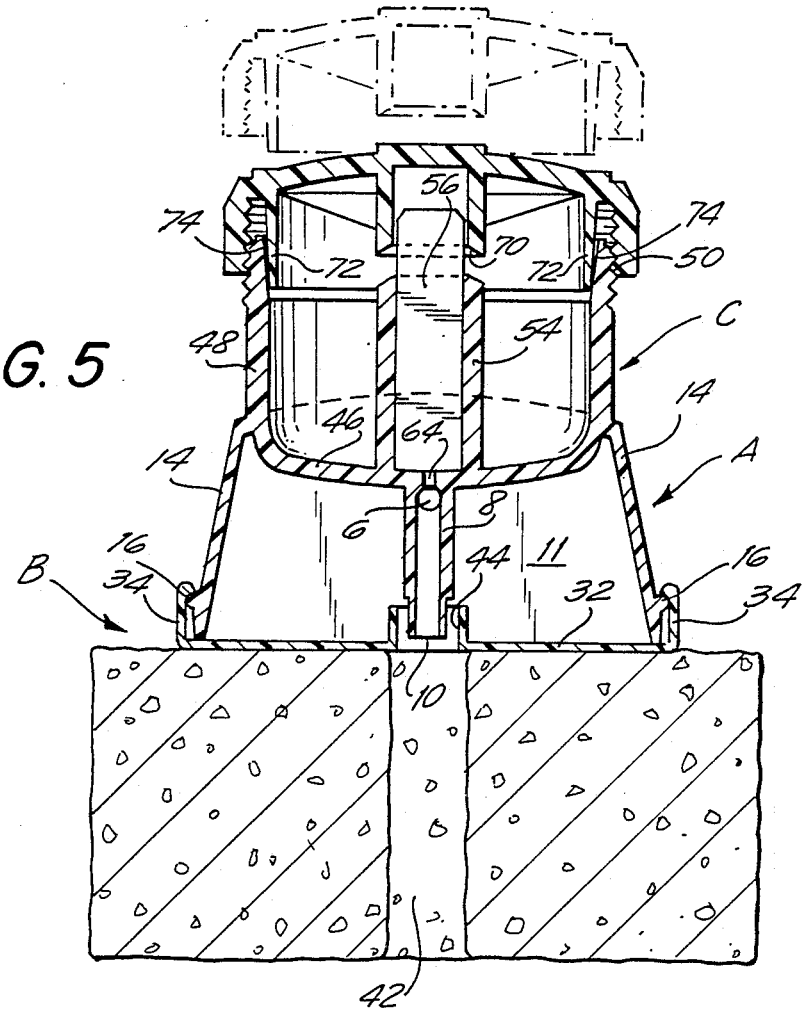
FIG. 5 is a view taken along the line 5—5 of FIG. 4 and showing the detergent container cover in solid lines in a position enabling mixture of detergent with water and showing that cover in broken lines in its position removed from the reservoir for detergent-filling purposes.
Figure 6:
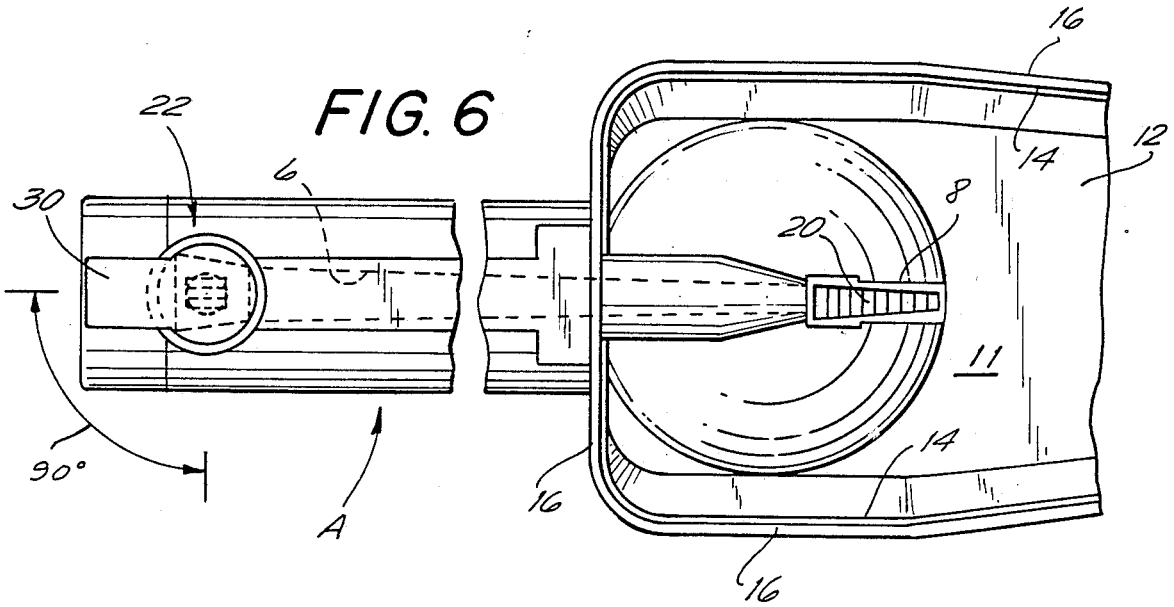
FIG. 6 is a fragmentary bottom plan view of the carrier of FIG. 1.

When the reservoir cover 52 is screwed all the way down, as shown in FIG. 4, its flange 72 will engage the wall 48 to seal the interior of the reservoir, thus preventing escape of any detergent that may be in the reservoir. At the same time the cup 68 will be pressed down against the tube 54, the surfaces 66 and 70 engaging, thus sealing the passages 58 and 60 off from the interior of the reservoir. Also the bottom of the cup almost touches the top of the upper end of the partition 56. When the assembly is connected to a water source and the on-off control 22 is "on", water will flow through the passage 6, it will impinge on the wall 18 and the ridged surface 20, it will be directed downwardly thereby in a diffused fashion, and it will flow through the tube 8, the opening 44 and the gap 42 in the brush head B directly to the surface being cleaned. A very small amount of water may flow up through opening 62 and passage 58 because of the pressure differential between the openings 62 and 64, but that water will then flow down through passage 60 and opening 64, there will be no contact with any detergent in the reservoir, and hence only water will be applied to the surface operated upon.

If the operator wishes to use detergent, all that he need do is unscrew the reservoir cap 52 a little. The cup 68 will rise, a gap will be produced between the surfaces 66 and 70, some of the water flowing up through the passage 58 because the pressure at opening 62 is greater than the pressure at the opening 64 will then flow into the reservoir and mix with detergent, the water and detergent mixture will flow into passage 60 and down through opening 64, and it will then mix with the water which is being directed to the surface being cleaned. The amount of detergent thus applied to that surface can be readily controlled simply through screwing or unscrewing the reservoir cover 52 to desired degree, the flange 72 on that cover maintaining its sealing relationship with the reservoir wall 48 throughout that degree of movement, so that detergent will not escape from the reservoir.

The water, with or without detergent as desired, flows copiously and relatively directly onto the surface to be cleaned, with the brushing effect of the brush element 40 being accomplished by rubbing the lower surface of the brush element 40 over that surface.

To change from one brush head to another is simple in the extreme. All that need be done is to grasp the tab 38 and pull it down, thus snapping the projections 36 down past the bead or ridge 16, thus disengaging the brush head from the carrier. The new brush head is put into place simply by pressing it onto the carrier until the internal projections 36 snap up over the bead 60.

The design is such that all of the parts can be readily manufactured in a plastic molding operation, thus making for economy of cost, while the parts themselves are simple and sturdy, involving no moving parts, thus making for longevity and reliability as well as inexpensiveness.

While but a single embodiment of the present invention has been here disclosed, it will be apparent that many variations may be made therein, all within the scope of the invention as defined in the appended claims.

We claim:

1. In a fountain brush assembly comprising a carrier and a brush head mounted thereon, said carrier comprising a housing and including fluid conduit means communicating between the exterior of said housing and an exit portion operatively related to said brush head, a detergent reservoir on said carrier, said conduit means adjacent said reservoir comprising walls defining upstream and downstream portions of decreasing size with openings in said walls at said upstream and downstream portions respectively, said reservoir comprising a fluid flow tube partitioned into two passages communicating respectively with said openings and having exit openings communicating with said reservoir, said reservoir having a cover movable between detergent-filling, detergent-flow and detergent-blocking positions, and control means carried by said cover and movable into and out of operative engagement with said exit openings to prevent fluid flow therethrough from said conduit means through said reservoir and back to said conduit means when said cover is in its detergent-blocking position, to permit such fluid flow when said cover is in its said detergent-flow position, and to open said reservoir to outside access for detergent filling when in said detergent-filling position.

2. The fountain brush assembly of claim 1, in which said cover is rotatably mounted on said reservoir for movement between said positions.

3. The assembly of any of claims 1, or 2, in which the axes of said conduit means wall openings diverge substantially from the direction of fluid flow in said conduit.

4. The assembly of any of claims 1, or 2, in which the axes of said conduit means wall openings are substantially at right angles to the direction of fluid flow in said conduit.

5. The assembly of any of claims 1, or 2, in which said two tube passages communicate with one another when said cover is in said detergent-blocking position.

* * * * *